United States Patent [19]

Nagashima et al.

[11] Patent Number: 4,638,706

[45] Date of Patent: Jan. 27, 1987

[54] ELECTRONICAL MUSICAL INSTRUMENT WITH NOTE FREQUENCY DATA SETTING CIRCUIT AND INTERPOLATION CIRCUIT

[75] Inventors: Yoichi Nagashima, Hamamatsu; Tatsunori Kondo, Shizuoka; Kiyomi Takauji, Hamamatsu; Mineo Kitamura, Hamamatsu; Tadashi Matsushima, Hamamatsu; Eiji Nagashima, Kami; Masafumi Mizoguchi, Hamamatsu, all of Japan

[73] Assignee: Kabushiki Kaisha Kawai Gakki Seisakusho, Japan

[21] Appl. No.: 665,126

[22] Filed: Oct. 26, 1984

[30] Foreign Application Priority Data

Oct. 27, 1983 [JP] Japan ..... 58-201664

[51] Int. Cl.[4] ..... G10H 7/00

[52] U.S. Cl. ..... 84/1.01; 84/1.21; 84/1.22

[58] Field of Search ..... 84/1.01, 1.11–1.13, 84/1.19–1.23, 1.26

[56] References Cited

U.S. PATENT DOCUMENTS

| | | | |
|---|---|---|---|
| Re. 31,653 | 8/1984 | Takeuchi | 84/1.21 |
| 3,908,504 | 9/1975 | Deutsch | 84/1.19 |
| 4,205,575 | 6/1980 | Hoskinson et al. | 84/1.01 |
| 4,246,823 | 1/1981 | Wachi et al. | 84/1.22 |
| 4,257,303 | 3/1981 | Nagai et al. | 84/1.22 |
| 4,352,312 | 10/1982 | Whitefield et al. | 84/1.21 |
| 4,444,082 | 4/1984 | Whitefield | 84/1.21 |
| 4,478,124 | 10/1984 | Kikumoto | 84/1.19 |
| 4,479,411 | 10/1984 | Ishibashi | 84/1.01 |
| 4,536,853 | 8/1985 | Kawamoto et al. | 84/1.01 X |
| 4,562,763 | 1/1986 | Kaneko | 84/1.01 |
| 4,566,364 | 1/1986 | Katoh | 84/1.19 |

*Primary Examiner*—S. J. Witkowski

*Attorney, Agent, or Firm*—McGlew and Tuttle

[57] ABSTRACT

In an electronic musical instrument which generates a musical waveform by calculating the waveform amplitude value at each sample point through Fourier synthesis, note-range variations of the musical waveform and its timbre variations in accordance with a touch response are controlled with respect to readout addresses for reading out a set of harmonic coefficient data for the Fourier synthesis from a memory having stored therein a plurality of sets of such harmonic coefficient data, thereby changing the component ratio of a harmonic coefficient which will ultimately be used as a Fourier coefficient.

2 Claims, 14 Drawing Figures

ELECTRONICAL MUSICAL INSTRUMENT WITH NOTE FREQUENCY DATA SETTING CIRCUIT AND INTERPOLATION CIRCUIT

BACKGROUND OF THE INVENTION

1. Field of the Invention

The present invention relates to an electronic musical instrument of the type that generates a musical waveform by computing the amplitude value of a musical waveform at each sample point thereof through Fourier synthesis, and more particularly to an electronic musical instrument which is adapted so that a harmonic coefficient for setting a timbre is varied and in accordance with a touch response and the note range of a musical sound.

2. Description of the Prior Art

Heretofore, there have been proposed many digital type electronic musical instruments which produce the amplitude value of a musical waveform at each sample point thereof by some method and read it out at a read-out rate corresponding to a note frequency. The simplest one of them is what is called a "waveform-memory method" which stores and reads out waveform data itself, and a method that converts an analog input to digital form to obtain waveform data is also one of the simplest methods. However, these conventional methods need an enermous memory capacity for varying the musical waveform in accorcance with the note range of a musical sound, and they are not satisfactory in practice. Furthermore, there have also been considered a method of computing parameters through the use of various continous functions and a method of computing note-range variations in the musical waveform in a real-time waveform systhesis by a frequency modulation method, but the correspondence between a parameter for the waveform generation and the timbre of the musical sound actually produced is unnatural to the human sense, and a desired timbre is difficult to obtain.

On the other hand, a musical waveform generating system utilizing Fourier synthesis has undergone various improvements to make up for the defect of a large volume of waveform synthesis calculation and has been widely employed since parameters for harmonic coefficients naturally correspond to an auditory evaluation of timbre. In the musical waveform generation system utilizing Fourier synthesis, it is the component ratio of a harmonic coefficient that determines the timbre of a musical sound. As a method for causing note-range variations in the musical waveform, there has been suggested a method of selecting many harmonic coefficients by using a plurality of memories, but this method has such a shortcoming that sufficient timbre variations cannot be obtained in spite of an enormous circuit scale. Furthermore, a system which multiplies a preset harmonic coefficient and a parameter of a Formant filter, as described in Japanese Patent Publication No. 46445/78 and a system which multiplies a note-range variation function for each harmonic coefficient, as described in Japanese Patent Public Disclosure No. 172396/84, both require a multiplication circuit and possess such a defect that its circuit scale and operation time impose limitations on the entire system, resulting in note-range variations of the musical waveform being insufficient.

SUMMARY OF THE INVENTION

It is therefore an object of the present invention to provide an electronic musical instrument which produces noterange variations in a harmonic coefficient, without using a multiplier, thereby simplifying its circuit arrangement and reducing its operating time.

Briefly stated, according to the present invention, note-range variations of a musical waveform and its timbre variations in accordance with a touch response are controlled with respect to readout addresses for reading out a set of harmonic coefficient data for Fourier synthesis from a memory circuit having stored therein a plurality of sets of such harmonic coefficient data, thereby changing the component ratio of a harmonic coefficient which will ultimately be used as a Fourier coefficient.

BRIEF DESCRIPTION OF THE DRAWINGS

FIG. 3(*b*) is a graph showing the harmonic status which is read out by the address generator of the example shown in FIG. 2;

FIG. 3(*c*) is a graph showing the harmonic co-efficient data which are read out at intervals from the harmonic data of FIG. 3(*b*);

FIG. 5(*b*) is a graph showing the read-out addresses from a read-out generator of the embodiment of FIG. 4;

FIG. 5(*c*) is a graph showing the interpolation values in the form of harmonic structure of a musical wave form generated by the embodiment of FIG. 4;

FIG. 8(*b*) is a graph showing how the envelope characteristic of the musical sounds from a natural instrument can be broken up into separate rectangular curves for the operation of the embodiment shown in FIGS. 6 and 7; and FIG. 8(*c*) is a graph showing binary shifts of the level of note-range variation data which can be added to a bias value in operating the embodiment of FIGS. 6 AND 7.

DESCRIPTION OF THE PREFERRED EMBODIMENTS

Figure 1:
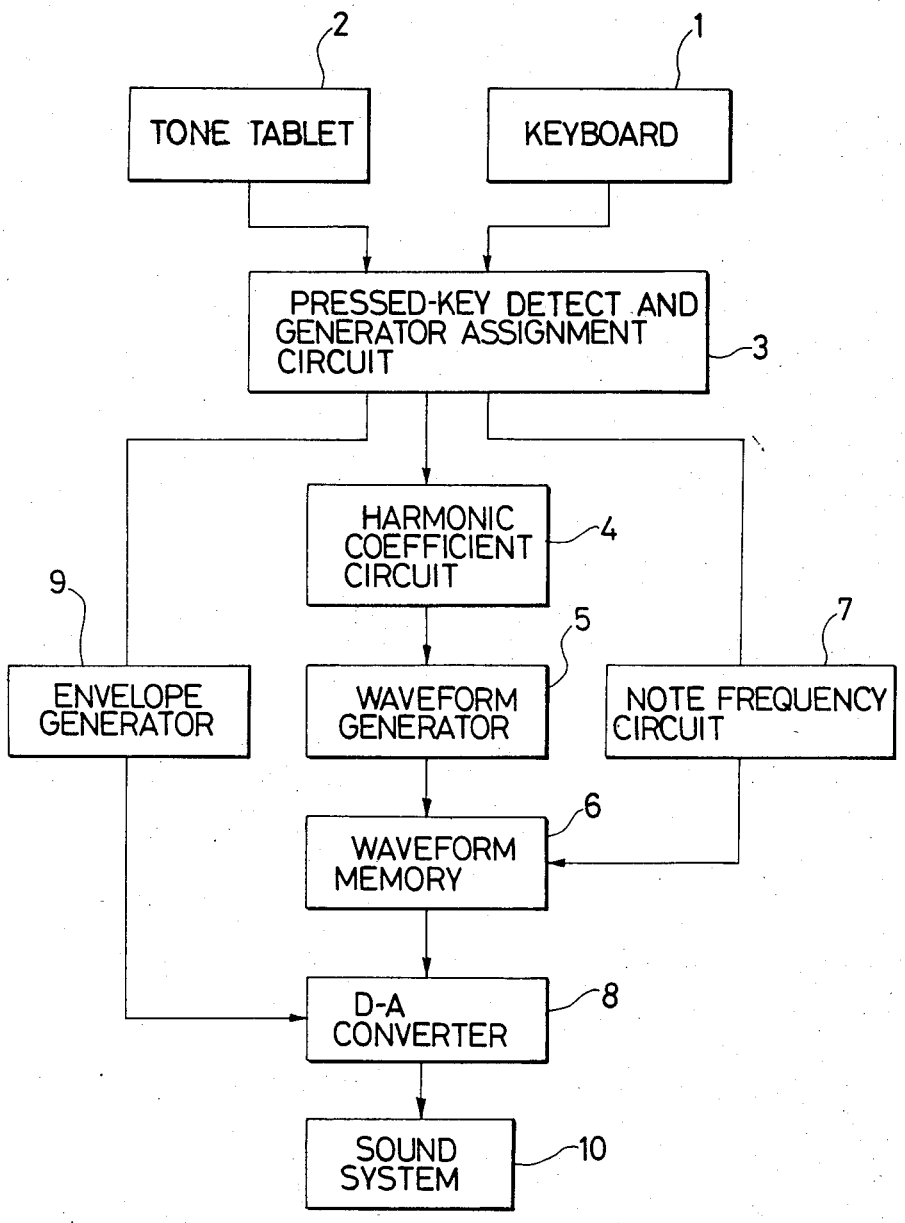
FIG. 1 is a block diagram which explains the arrangement of the electronic musical instrument of the present invention.

FIG. 1 illustrates, in block form, the arrangement of the electronic musical instrument of the present invention. Reference numeral 1 indicates a keyboard; 2 designates a tone tablet; 3 identifies a pressed-key detect and generator assignment circuit; 4 denotes a harmonic coefficient circuit, 5 represents a waveform generator; 6 shows a waveform memory; 7 refers to a note frequency circuit; 8 signifies a D-A converter; 9 indicates an envelope generator; and 10 designates a sound system.

The pressed-key detect and generator assignment circuit 3 supplies each of the harmonic coefficient circuit 4, the note frequency circuit 7 and the envelope generator 9 with a control signal corresponding to timbre data an performance data input from the keyboard 1 and the tone tablet 2. The harmonic coefficient circuit 4 responds to the timbre data from the pressed-key detect and generator assignment circuit 3 to set Fourier harmonic coefficients for waveform synthesis calculations. The waveform generator 5 sequentially calculates and synthesizes musical waveform data on the basis of the Fourier harmonic coefficients from the harmonic coefficient circuit 4 and provides it to the waveform memory 6. The note frequency circuit 7 responds to the performance data from the pressed-key detect and generator assignment circuit 3 to generate a readout signal corresponding to a musical frequency, by which signal the musical waveform data corresponding to the musical frequency is read out of the waveform memory 6. The envelope generator 9 responds to the performance data from the pressed-key detect and generator assignment circuit 3 to set amplitude modulation data such as the attack and decay of each musical sound and its envelope characteristic. By performing the above operations digitally on a timeshared basis, the circuit arrangement can be simplified. The D-A converter 8 converts the musical waveform data corresponding to the musical frequency, read out by the note frequency circuit 7 from the waveform memory 8, into analog form and multiplies it by the amplitude modulation data from the envelope generator 9, obtaining an analog signal output. The analog signal output from the D-A converter 8 is converted, by the sound system 10 including an effect circuit, and amplifier and a speaker, into a musical sound of the electronic musical instrument.

Figure 2:
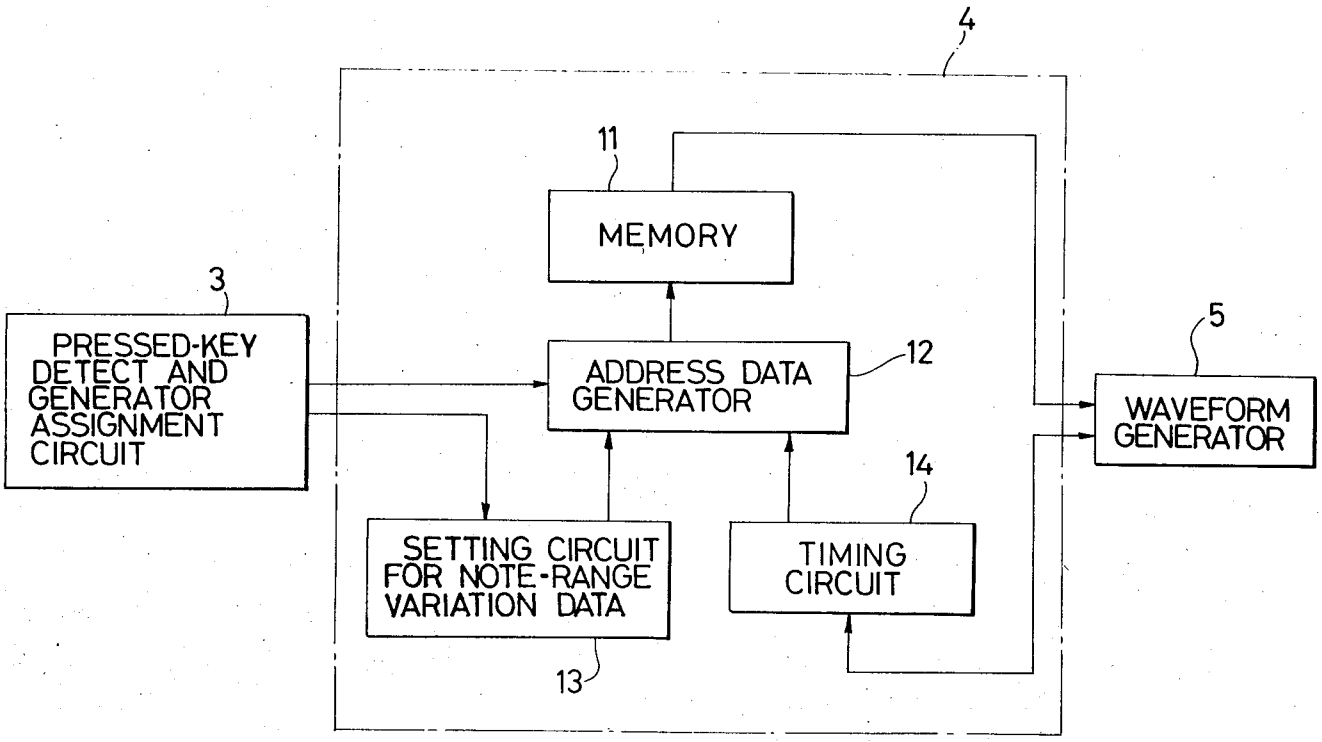
FIG. 2 is a block diagram illustrating a specific operative example of the arrangement of a harmonic coefficient circuit 4 shown in FIG. 1.

FIG. 2 illustrates a specific operative example of an arrangement for processing note range variations of the musical waveform according to the present invention which is provided in the harmonic coefficient circuit 4 used in FIG. 1. In FIG. 2, reference numeral 11 indicates a memory circuit which stores a plurality of sets of harmonic coefficient data each set of which is used for Fourier synthesis, 13 designates a setting circuit for note range variation data which generates data for varying the component ratio of the harmonic coefficient in terms of note-range in response to the note-range variations of the musical waveform; 12 identifies an address data generator which generates readout addresses for reading out the harmonic coefficient data from the memory circuit 11 while varying them in accordance with the note-range variation data; and 14 denotes a timing circuit for synchronizing the time-shared operations of the waveform generator 5 and the address data generator 12.

A description will be given, with reference to FIG. 2, of the operation of computing and synthesizing a musical waveform by the waveform generator 5. In general, amplitude values of the musical waveform are sequentially computed by the waveform generator 5 in accordance with the following expression:

$$F(s) = \sum_{n=1}^{N} Cn \cdot \sin(2\pi ns/S) \tag{1}$$

where n is the degree of harmonics, N is the highest degree of the harmonics, s is a sample point, S is the number of samples in one cycle and Cn is a harmonic coefficient set by the harmonic coefficient circuit 4. The expression (1) is sufficient for synthesizing a timbre of a musical waveform which is constant regardless of the note range of a musical sound, but in the case of synthesizing a musical waveform which varies with the note range, it is necessary to perform the following operation using a parameter of corresponding to the note frequency or note range of the musical sound, in addition to the sampling constants:

$$F(s,f) = \sum_{n=1}^{N} Cn(f) \cdot \sin(2\pi ns/S) \tag{2}$$

In the case of the method which employs a Formant function K(f) as referred to previously, since the harmonic coefficient Cn(f) corresponding to the note range is computed as follows:

$$Cn(f) = Cn \cdot K(f) \tag{3}$$

the entire operation for the musical waveform becomes as follows:

$$F(s,f) = \sum_{n=1}^{N} Cn \cdot K(f) \sin(2\pi ns/s) \tag{4}$$

As a result of this, the multiplying operation, which is given much weight in the circuit operation of the electronic musical instruments, is needed twice for each sample point, so that it is necessary to limit the number of harmonics or the number of sample points for one cycle according to the scale of the circuit used and its operating speed.

With such an arrangement as shown in FIG. 2, the note-range varying musical waveform is obtained by the memory circuit 11, the note-range variation data generator 13 and the address data generator 12 without involving such a multiplying operation as mentioned above. The harmonic coefficient Cn(f) corresponding to the note range is obtained by the following operation using an address Ad for reading out the memory circuit 11:

$$Cn(f) = Cn(Ad(f)) \tag{5}$$

Figure 3A:
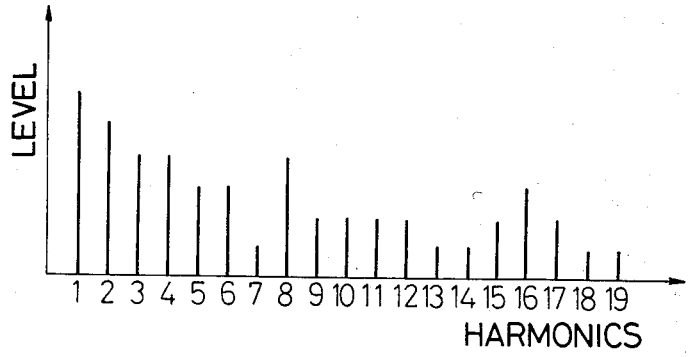
FIG. 3(*a*) is a graph showing the harmonic coefficients in a Fourier synthesis system which are stored in memory for a wave form sythesizing calculation for the operation of the example shown in FIG. 2.
Figure 3B:
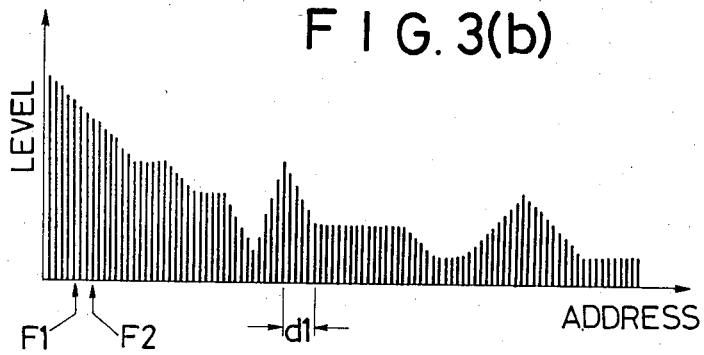
Figure 3C:
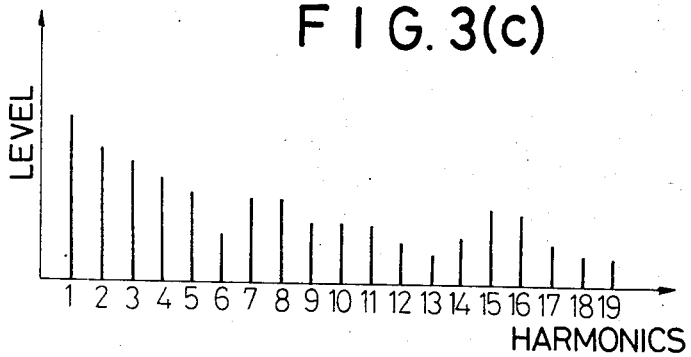

This is merely a memory addressing operation and hence can easily be performed without involving the use of a complicated arithmetic circuit. This operation will be described with reference to FIG. 3(*a*) to 3(*c*). In the Fourier synthesis according to the prior art system, such harmonic coefficients as shown in FIG. 3(*a*) are prepared in a harmonic coefficient memory for the waveform synthesizing calculation and the waveform generation is carried out according to the expression (1). In the present invention, however, the function of the memory circuit 11 differs from the function needed in the conventional system. The memory circuit 11 in FIG. 2 has stored therein such harmonics data as shown in FIG. 3(*b*), which is not in the form of Fourier coefficients of n-th harmonics such as shown in FIG. 3(*a*) but is merely a series of harmonics data having a certain structure. In the case where the harmonics data shown in FIG. 3(*b*) is read out, by the address data generator 12 in FIG. 2, at intervals of dl, starting at, for example, an address F1, such harmonic coefficient data as shown in FIG. 3(*a*) is obtained. When the harmonics data of FIG. 3(*b*) is read out at intervals of d1, starting at an address F2, such harmonic coefficient data as shown in FIG. 3(*c*) is obtained. Comparison of the harmonic coefficient structures of FIGS. 3(*a*) and (*c*) reveals that the both data are generally similar in profile to the harmonics data of FIG. 3(*b*) but greatly different in the levels of some characteristic harmonics which affect timbre. Such a characteristic that the musical waveform can be controlled only by slightly controlling the read out addresses from the address data generator 12 in FIG. 2 while the general tendency of the musical sound is retained. This is ideal for the musical waveform generating system of electronic musical instruments.

The note-range variation data setting circuit 13 in FIG. 2 sets, as timbre variations corresponding to the note range of a musical sound, note-range variation data corresponding to, for example, different timbres of a piano in high and low frequency ranges, different timbres of a saxophone in respective note ranges (soprano, alto, tenor, bass, etc.), metallic sounds characteristic of the high frequency range of the timbre of a Glockenspiel and so forth. The note-range variation data setting means can be formed by a memory circuit from which note-range variation data is read out by the control signal supplied from the pressed-key detect and generator assignment circuit 3 in response to the timbre data and performance data input from the keyboard 1 and the tone tablet 2, or by a simple arithmetic circuit which calculates and sets required note-range variation data on a real time basis. The note frequency of a musical sound settles for the first time at the moment of turning ON of each keyboard and remains constant until the keyboard is turned OFF, so that in the case where the waveform generator 5 performs the waveform synthesis calculations in a plurality of sound producing channels on a time-shared basis, it is necessary to set the note-range variation data for each calculation in each sound producing channel. The timing circuit 14 supplies the address data generator 12 with data on the degree of harmonics obtained by the Fourier calculation in the waveform data generator 5, and at the same time, controls the timing of time-shared operations of the entire circuit. When obtaining the harmonic coefficient data read out by the address data generator 12 from the memory circuit 11 according to the expression (2), it is seen that the operation of the waveform data generator 12 at a certain sample point s is a combincation of a multiplication and an accumulation every n-th harmonics by which the result of multiplication, G(n, s t), every h-th harmonics given by $$G(n, s f) = Cn(f) \cdot \sin(2\pi ns/S) \tag{6}$$

is accumulated to an N-th degree as follows:

$$F(s,f) = \sum_{n=1}^{N} G(n, s, f) \tag{7}$$

For each time slot of this multiplication, the address data generator 12 receives degree-of-harmonics data n from the timing circuit 14 and note-range variation data from the note-range variation data setting circuit 13. Here, an address for reading out an n-th harmonic coefficient of such harmonics data of FIG. 3(*b*) in a note-range f can be set as follows:

$$Ad(f, n) = P1 + (n-1) \cdot d + W(f) \tag{8}$$

where P1 is an address for reading out the harmonic coefficient of a fundamental tone (a first harmonics), d is a "skip" value for the aforementioned "skipped" readout and W(f) is note-range variation data. The calculation of the expression (8) appears to be troublesome. In practice, however, if the skip value d is selected to be a fixed high-order address of the memory, then the actual operation becomes a mere addressing operation and the note-range variation data W(f) is a function of the note-range variation parameter f alone and varies only when the keyboard is turned ON and OFF, so that the calculation of the expression (8) is easy to achieve. For such an address, the memory circuit 11 functions as a kind of translation table M which provides the harmonic coefficient Cn(f) in the expression (5) and supplies the waveform generator 5 with such harmonics data as follows:

$$Cn(f) = M(Ad(f, n)) = M(P1 + (n-1) \cdot d + W(f) \tag{9}$$

On the basis of the above data, the waveform generator 5 performs, for each multiplication time slot, the following operation:

$$G(n, s, f) = (M(P1 + (n-1) \cdot d + W(f) \cdot \sin(2\pi ns/S) \tag{10}$$

For synchronizing the three timed-shared operation parameters n, s and f, the timing circuit 14 latches data necessary therefor and supplies required latch pulses to the circuits concerned and, at the same time, it participates in the address formation by the address data generator 12.

Figure 4:
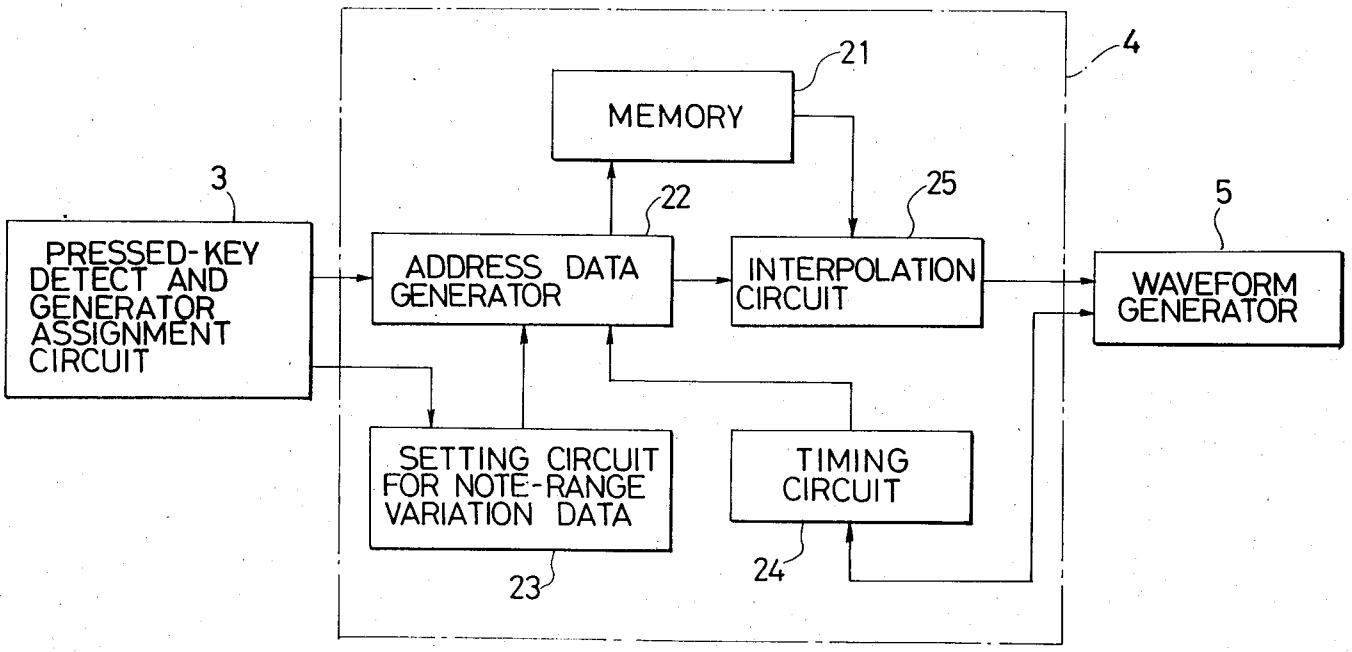
FIG. 4 is a block diagram illustrating another specific operative example of the arrangement of the harmonic coefficient circuit 4.

FIG. 4 illustrates another embodiment of the harmonic coefficient circuit 4. In FIG. 4, reference numeral 21 indicates a memory circuit which stores a plurality of sets of harmonic coefficient data each set of which is used for Fourier synthesis; 23 designates a note-range variation data generator which generates data for varying the component ratio of the harmonic coefficient in terms of note range in response to the note-range variations of a musical waveform; 22 identifies an address data generator which generates addresses for reading out the harmonic coefficient data from the memory circuit 21 while varying them in accordance with the note-range variation data; 25 denotes an interpolation circuit for interpolating the harmonic coefficient data read out from the memory circuit 21 by the readout addresses from the address data generator 22; and 24 represents a timing circuit for synchronizing the time-shared operations of the waveform generator 5, the address data generator 22 and the interpolation circuit 25.

Figure 5A:
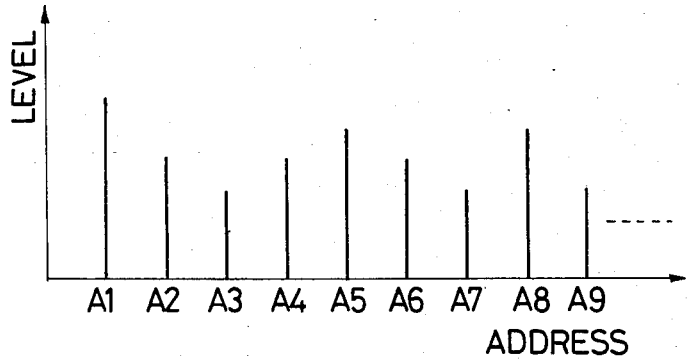
FIG. 5(*a*) is a graph showing the harmonic coefficient data which is stored in the memory of the embodiment shown in FIG. 4.
Figure 5B:
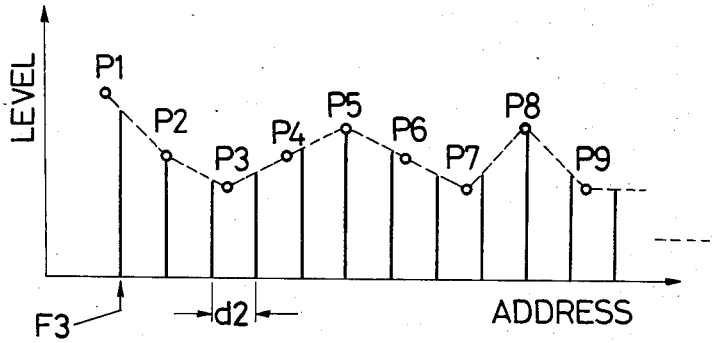
Figure 5C:
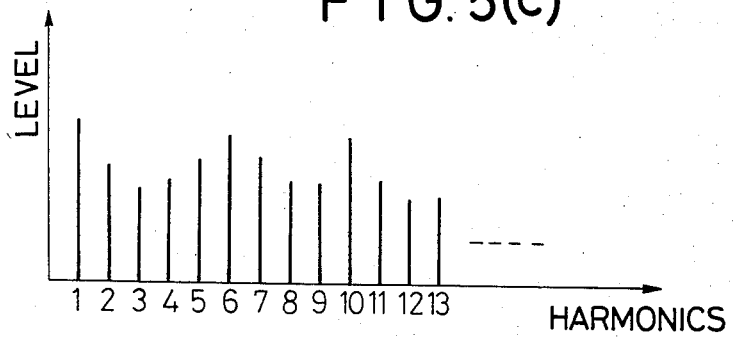

A description will be given, with reference to FIGS. 5(*a*) to 5(*c*), of the operation of the operation of the embodiment of FIG. 4. In this embodiment, harmonic embodiment coefficient data such, for example, as shown in FIG. 5(*a*) is stored, as a representative value, in the memory circuit 21. The data itself does not correspond directly to the harmonic coefficient structure of a musical waveform but can be formed arbitrarily in accordance with the musical waveform to be synthesized. When the readout addresses from the address data generator 22 are set by the expression (8) so that F3 in FIG. 5(*b*) is the start of the readout and d2 is the skip value, interpolation values corresponding to harmonic coefficient data Pl, P2, . . . in the memory circuit 21 are computed by the interpolation circuit 25. FIG. 5(*c*) shows the interpolation values in the form of harmonic structure of the musical waveform. It is seen from FIG. 5(*c*) that the harmonic coefficient structure is effectively set by the readout addresses from the address data generator 22. The arrangement of this embodiment appears more complex than the arrangement of FIG. 2, but since the storage capacity required of the memory circuit 21 is much smaller than in the case of the latter, this circuit arrangement is rather useful in practice and can be simplified by employing nonlinear interpolation by a shift circuit as the interpolation system of the interpolation circuit 25.

Figure 6:
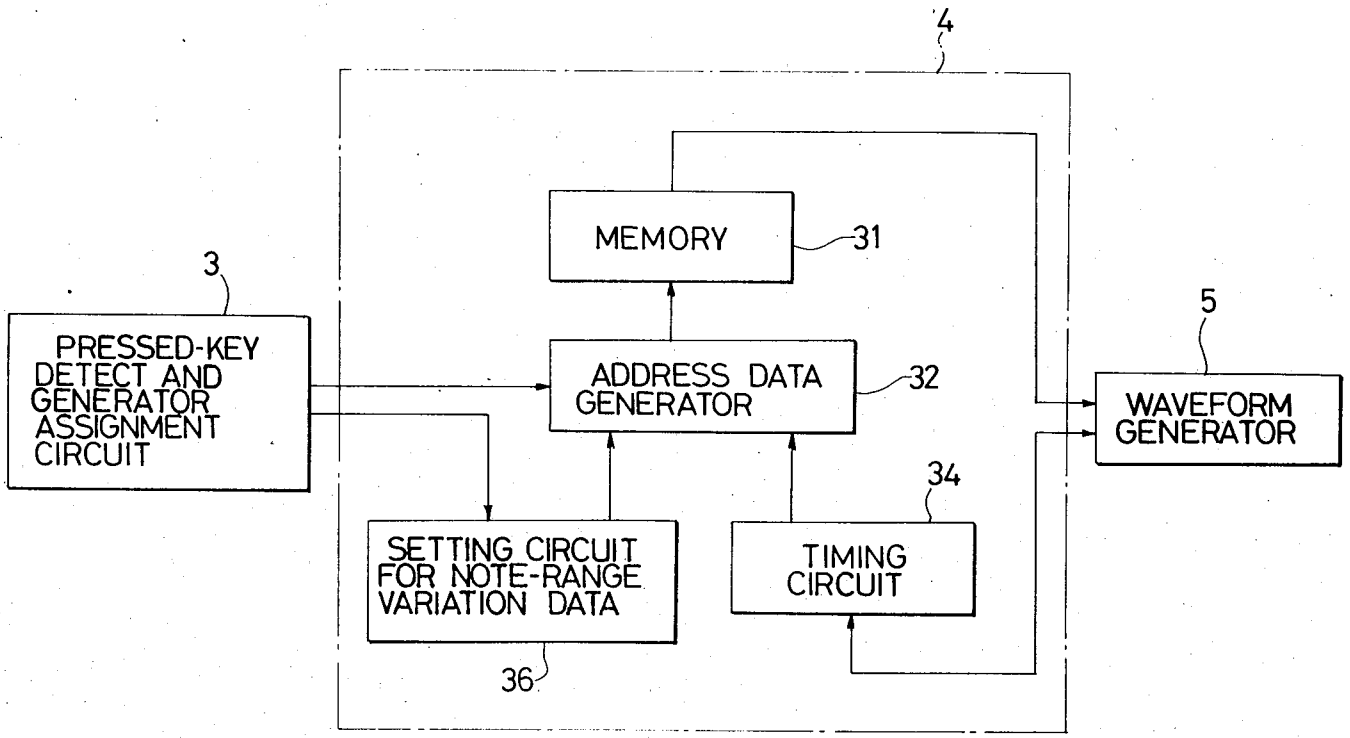
FIG. 6 is a block diagram illustrating still another specific operative example of the arrangement of the harmonic coefficient circuit 4.

FIG. 6 illustrates another embodiment of the harmonic coefficient circuit 4. In FIG. 6, reference numeral 31 indicates a memory circuit which stores a plurality of sets of harmonic coefficient data each set of which is used for Fourier synthesis; 36 designates a note-range variation data generator which generates, in accordance with touch response data from the pressed-key detect and generator assignment circuit, data for varying the component ratio of the harmonic coefficient in terms of note range in response to the note-range variations of a musical waveform; 32 identifies an address data generator which generates addresses for reading out the harmonic coefficient data from the memory ciruit 31 while varying them in accordance with the note-range variation data; and 34 denotes a timing circuit for synchronizing time-shared operations of the waveform generator 5 and the address data generator 32.

Figure 7:
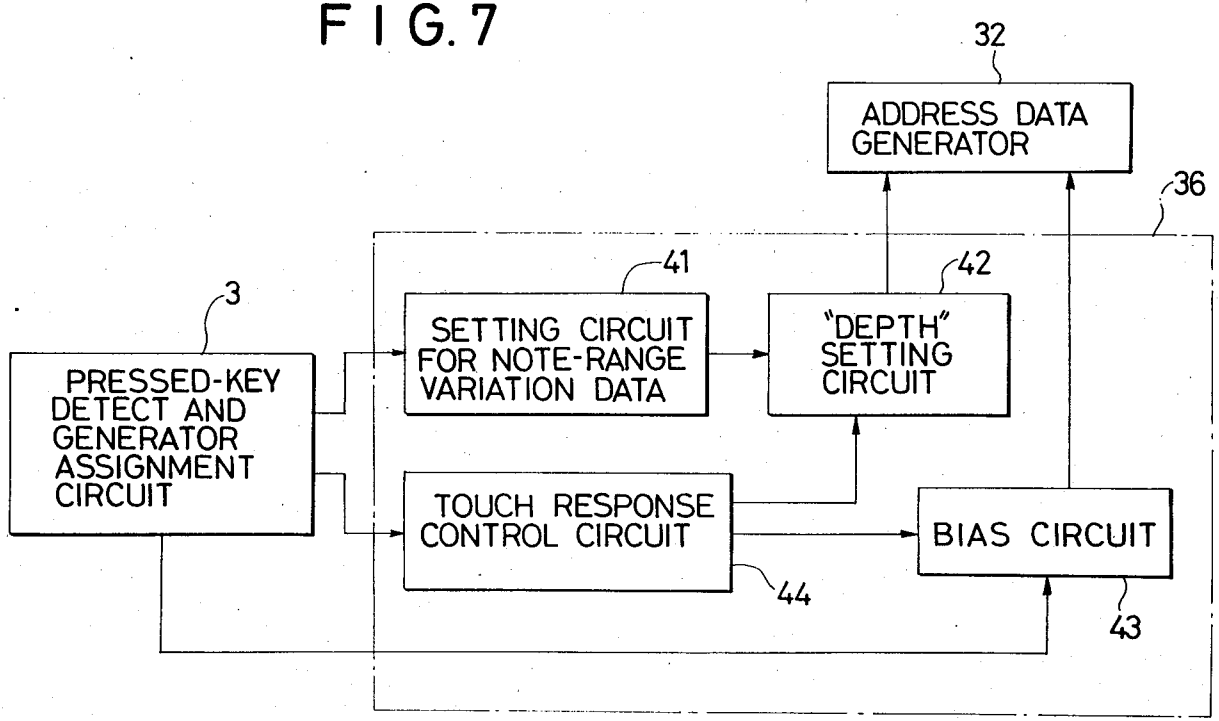
FIG. 7 is a block diagram illustrating a specific operative example of the arrangement of a note-range variation data setting circuit 36 used in FIG. 6.

FIG. 7 illustrates a specific example of the arrangement of the note-range variation data generator 36, explanatory of its operation. In FIG. 7, reference numeral 41 indicates a note-range variation data setting circuit which sets data for varying the component ratio of the harmonic coefficient in terms of note range in accordance with note-range variations of a musical waveform; 42 designates a "depth" setting circuit for setting the amount of effect of the note-range variation data generated by the note-range variation data setting circuit 41; 43 identifies a bias setting circuit for setting a bias value in accordance with touch response data during performance; and 44 denotes a touch response control circuit for controlling the "depth" setting circuit 42 and the bias setting circuit 43 in accordance with the touch response data form the pressed-key detect and generator assignment circuit 3.

Figure 8A:
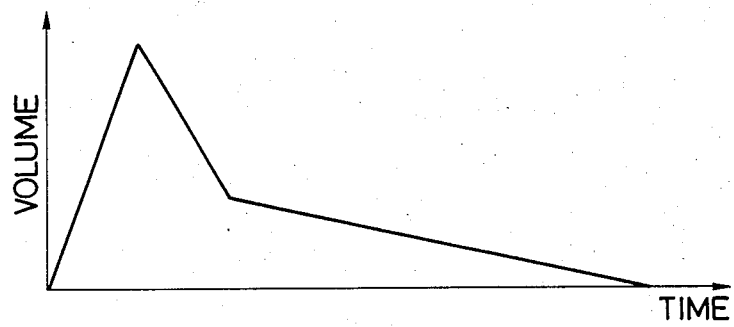
FIG. 8(*a*) is a graph showing an envelope characteristic for musical sounds of a natural musical instrument.
Figure 8B:
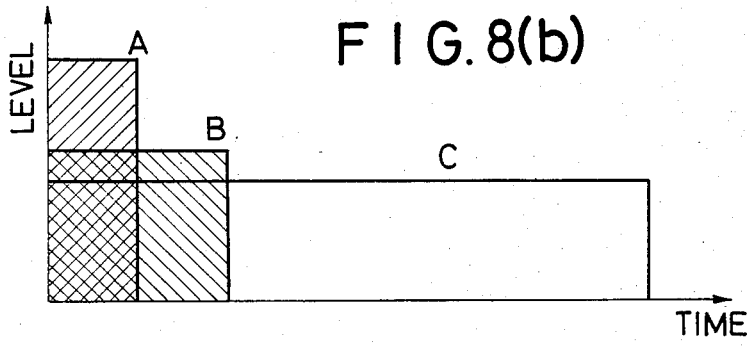
Figure 8C:
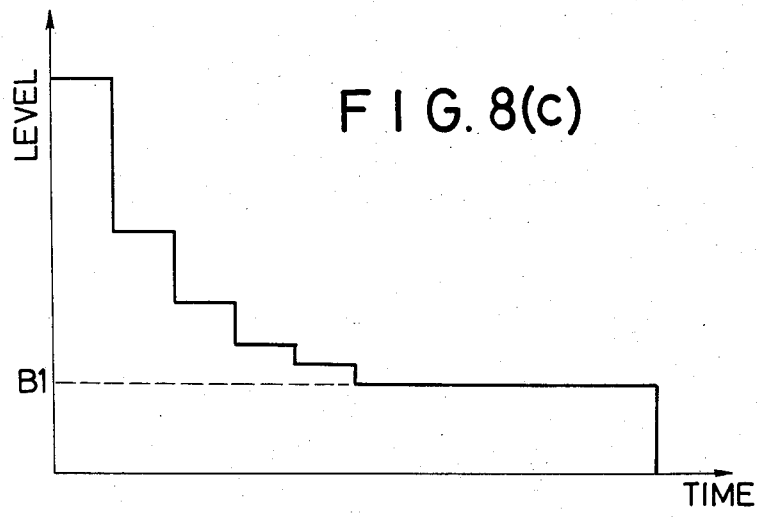

A description will be given, with reference to FIGS. 8(*a*) to 8(*c*), of the operation of the embodiment of the present invention shown in FIGS. 6 and 7. In general, musical sounds of natural musical instruments of the damped sound series, for example, a piano, a guitar, a vibraphone, a drum, etc., have such an envelope characteristic or temporal volume variation curve as shown in FIG. 8(*a*). In the case of generating such a musical signal by electronic musical instruments, no natural timbre can be obtained only by amplitude-modulating the waveform signal output of a waveform generator with such a volume curve as shown in FIG. 8(*a*). The reason for this is that especially in the case of the natural musical instrument of the damped sound series which involves a hammering operation, a specific timbre at the attack of a musical sound by hammering, such as indicated by the curve A or B in FIG. 8(*b*), serves as an important factor characteristic of each musical instrument, in addition to a sustaining timbre peculiar to the musical instrument which corresponds to the curve C shown in FIG. 8(*b*). In view of this, the touch response control circuit 44 provides, for a fixed period of time after the start of sound generation in each sound producing channel, touch response data to the depth setting circuit 42 to control the amount of timbre variation at the attack of the musical sound by hammering and to control the level of the sustaining timbre peculiar to the musical sound which is set by the bias setting circuit. Furthermore, by providing a simple exponential characteristic by a binary shift of the level of note-range variation data which is added to a bias value Bi, as shown in FIG. 8(*c*), a more effective touch response charcteristic can be achieved.

As has been described in the foregoing, according to the electronic musical instrument of the present invention, since harmonic coefficients necessary for Fourier synthesis calculations for realizing note-range variations of a musical waveform can be produced with a simple arrangement in a short time, it is possible to generate a truly musical waveform, overcoming limitations on the degree of harmonic coefficients, the sampling rate and the circuit scale. Furthermore, the present invention achieves simplification of the circuit arrangement and a touch response expression through utilization of an interpolation circuit and a touch response control circuit, and hence offers an electronic musical instrument of high musicality. Accordingly, the present invention greatly contributes to the creation of good music.

It will be apparent that many modifications and variations may be effected without departing from the scope of the novel concepts of the present invention.

What is claimed is:

1. An electronic musical instrument of the type that forms a musical waveform by calculating the waveform amplitude value at each sample point of the musical waveform through Fourier synthesis, comprising:

a memory circuit for storing a plurality of sets of artibrary harmonic coefficients for use in the Fourier synthesis, each set of arbitrary harmonic coefficients including a series of arbitrary harmonic coefficients occupying different addresses in said memory circuit, said arbitrary harmonic coefficients in each set having a characteristic wave pattern of a musical waveform to be synthesized;

a note frequency data setting circuit for setting a component ratio of a harmonic coefficient in accordance with the note frequency of a musical waveform to be synthesized, said note frequency data setting circuit selecting from and between the sets of arbitrary harmonic coefficients stored in said memory circuit;

an address data generator for generatig readout addresses for reading out one set of the arbitrary harmonic coefficients from the memory circuit in accordance with the note frequency data of the musical waveform to be synthesized;

an interpolation circuit for calculating actual harmonic coefficient data by starting at a starting address of the readout addresses from the address data generator, and by skipping by a selected skip value along the series of arbitrary harmonic coefficients in the readout addresses, the musical waveform to be synthesized having its characteristic wave pattern because of the selection of the set of arbitraryharmonic coefficients while having acual harmonic coefficients calculated by said interpolation circuit.

2. An electronic musical instrument according to claim 1, which includes a bias setting circuit for setting and adding a bias value to each of the readout addresses read out of the memory circuit, and a depth setting circuit for setting the amount of effect by the note frequency data set by the note frequency data setting circuit, and wherein the bias value by the bias setting circuit and the effect depth value by the depth setting circuit are controlled in accordance with tough response data during performance.

* * * * *